United States Patent [19]

Bergling

[11] 4,270,629

[45] Jun. 2, 1981

[54] LINKAGE SYSTEM FOR LOAD-LIFTING ARRANGEMENTS

[76] Inventor: Karl T. Bergling, Körsbärsvägen 4A, Stockholm, Sweden, S-114 23

[21] Appl. No.: 22,850

[22] Filed: Mar. 22, 1979

[30] Foreign Application Priority Data

Apr. 4, 1978 [SE] Sweden ..... 7803807

[51] Int. Cl.[3] ..... B66B 9/20

[52] U.S. Cl. ..... 187/9 E; 414/742

[58] Field of Search ..... 187/9 R, 9 E, 8.72, 187/8.71; 414/728, 742

[56] References Cited

U.S. PATENT DOCUMENTS

| | | | |
|---|---|---|---|
| 2,328,715 | 9/1943 | Drott | 414/742 |
| 3,155,251 | 11/1964 | Williamson | 414/728 |
| 4,054,185 | 10/1977 | Stedman | 187/9 E |

FOREIGN PATENT DOCUMENTS

| | | | |
|---|---|---|---|
| 931939 | 8/1955 | Fed. Rep. of Germany | 414/742 |

*Primary Examiner*—Robert J. Spar
*Assistant Examiner*—Kenneth Noland
*Attorney, Agent, or Firm*—Larson and Taylor

[57] ABSTRACT

A linkage system particularly for vehicle-carried lifting arrangements comprising a link (11) whose one end is pivotally connected to a link arm (10,14) at a location (13) between one end of the link arm and the other end (8) thereof, the one end being provided with a load-carrying member (3) and the other end being mounted in a horizontal guide (7) which is arranged, during a lifting or lowering operation, to guide the other end (8) of said link arm substantially linearly and horizontally. A lifting-force generating device (16), for example a hydraulic piston-cylinder arrangement, is connected with the link (11) in a manner such that, during a lifting or lowering operation, the end of the link arm having the load-carrying member can be moved vertically in a substantially straight line from a height position below the horizontal guide (7) to a height position above the guide (7) or vice versa while simultaneously moving the end (8) of the link arm mounted in the guide (7) horizontally. The other end (12) of the link is pivotally mounted on the vehicle and the hydraulic cylinder (16) is connected with the link (11) at a location (18) between the two ends thereof.

7 Claims, 5 Drawing Figures

LINKAGE SYSTEM FOR LOAD-LIFTING ARRANGEMENTS

Figure 1:
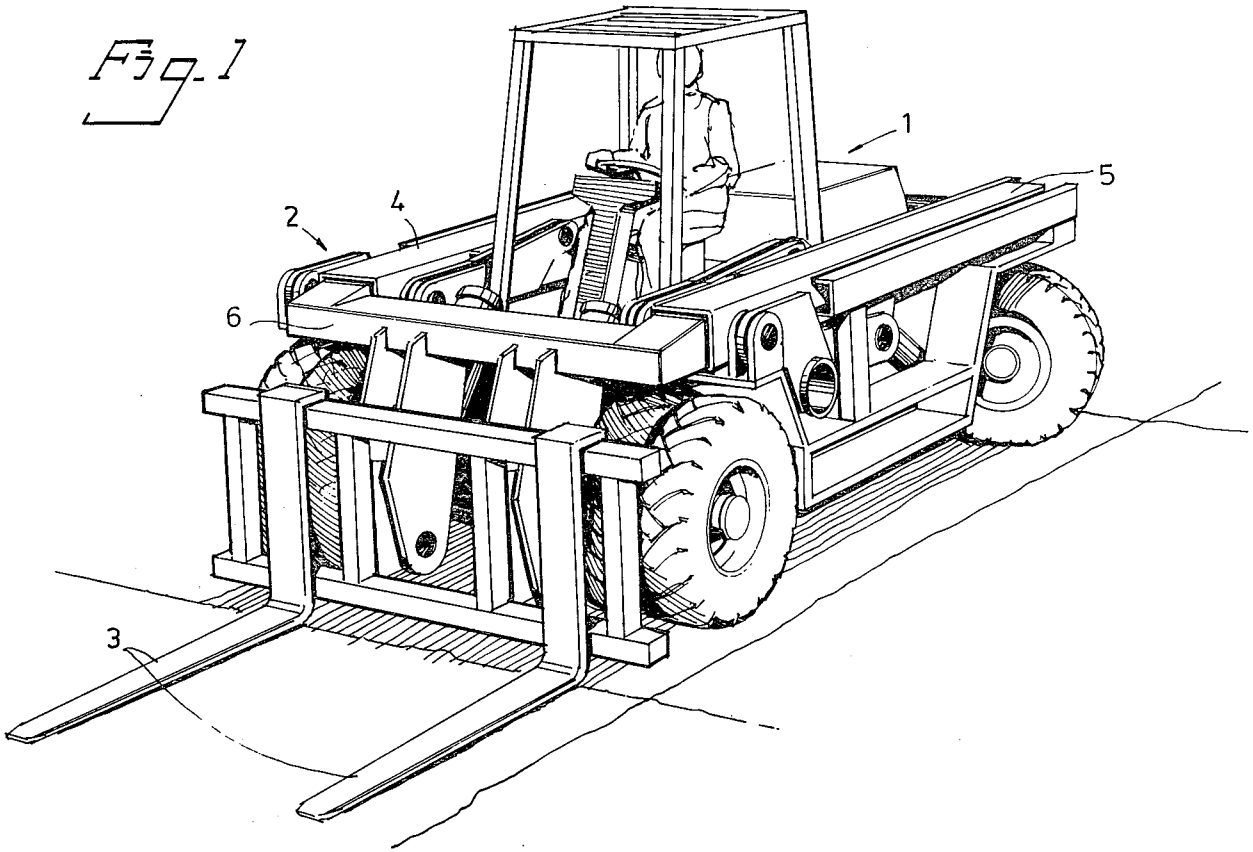

The present invention relates to a linkage system for load-lifting arrangements, particularly, although not exclusively, for vehicle-carried load-lifting arrangements, said linkage system including a link whose one end is pivotally connected to a link arm at a point between one end of the link arm and the other end thereof, said one end being provided with load-carrying means, and said other end being journalled in a guide arranged to guide said other end of said link arm substantially linearly and horizontally during a lifting and lowering operation.

Lifting trucks are particularly useful vehicles in the transport and materials handling field. Lifting trucks are normally provided with forks or other devices whereby a load can be lifted vertically, moved by the vehicle to an intended station and then unloaded onto a surface, which may be located at a higher or a lower level than the level from which the load was fetched.

In order to enable loads which are located, for example, closely adjacent to planar, vertical walls, it is sought to lift the load in a straight lifting path, thereby enabling the movement of the load to be readily controlled and to avoid, as far as possible, the occurrence of tilting moments caused by the load.

An important feature of such lifting vehicles is a high free-lift height, by which is meant the maximum vertical change in level of the load which can be achieved with the vehicle standing on a flat, horizontal surface, without increasing the total height of the vehicle above said surface. This is a particularly important feature in the case of low ceiling heights, for example on board ships.

The most common method of producing a rectilinear lift, is to cause the load-carrying arrangement to be guided in grooves with the aid of rails having telescopic devices or the like which are made rectilinear. Often, two beams having grooves arranged therein are assembled in a parallel relationship to form a frame structure. On this frame structure there is mounted a further frame structure which is provided with suitable bearings and which is arranged for movement in the direction of the grooves. When this frame structure is provided with load-carrying devices, the load can be lifted rectilinearly when suitable lifting forces are applied.

The lifting height of the vehicle can be increased without exceeding the permitted total transport height of the vehicle, by using a multiplicity of frame structures which are telescopically mounted one within the other.

Lifting trucks having the above described load-lifting arrangements exhibit several disadvantages, however. Inter alia the lifting height of the vehicle is relatively excessive even with relatively limited requirements on said lifting height. Furthermore, the vertical load-carrying guide beams of the aforedescribed constructions are so located as to obscure the view of the driver of the truck. Neither is it possible to obtain any appreciable free-lift height without making special modifications, which in addition to increasing costs also impairs the view of the driver still further. The aforementioned frame structures are often made narrower than the load-carrying means, which results in an asymmetric loading of the load-carrying means both in the vertical and the horizontal direction, causing wear and distortion in the bearings. The aforedescribed constructions also result in an unfavourable distribution of the pressure on the wheels of the vehicle.

Several solutions have been proposed for the purpose of eliminating the aforementioned disadvantages. One such solution is based on the concept of arranging a pair of rods or like elements which are pivotally mounted at their ends at locations placed on each side of a vehicle frame. The free ends of the rods can be used to move a load vertically. If the rods are rigid, the said free ends of the rods will describe circular arcs. This concept is often used on bucket loaders. In order to cause the free ends to move in a straight path, the rods can be made telescopic, such that their length can be changed. Consequently by means of a suitable control system arranged to control the length of the rods as a function of the rotation around the fixed locations, the free ends of the rods can be made to move in a manner such that the load is lifted in a precise or substantially precise straight path.

With such an arrangement, the view afforded to the driver, the total height of the vehicle and its free-lift ability are often considerably improved over those arrangements first described. The control system, which is necessary in order for the load to be lifted substantially rectilinearly, is expensive, however, and is often not precise. Moreover, if the control system should fail to function correctly, there is a risk of the load falling in an uncontrollable manner, resulting in damage to the load and possible injury to those in the vicinity thereof. The telescopic rods are also of a complicated design, and therewith expensive.

In some load-lifting vehicles, the vehicles are provided with raisable and lowerable platforms. Although the manner in which the platform is raised and lowered may vary from vehicle to vehicle, the most common method used is the so-called pantograph method. In accordance with this method, a rod is provided with three mutually equidistant pivot points arranged in line with one another. Two such rods are joined together at their centermost pivot points, thereby to form a scissor-like arrangement. The lower pivot point of one rod is attached to the vehicle. The lower pivot point of the other rod is provided with a wheel or runner which runs in a rail mounted on the vehicle, in a manner such that the geometric extension of the line along which the center of the wheel runs intersects the center of the vehicle attachment point of the pivot point of the first rod. The upper pivot point of the rod carrying the wheel will then pass rectilinearly at right angles to the direction of movement of the wheel. A further pantograph-like arrangement can be mounted on the free, upper pivot points of the aforedescribed arrangement, and a still further pantograph-like device can be arranged on the said further device, etc. etc. The platform is attached to one of the free pivot points of the last pantograph-like arrangement assembled. The other pivot point is provided with a wheel which runs in a rail mounted on the platform and parallel with the rail mounted on the vehicle. The platform can thus be moved rectilinearly in a parallel movement pattern. If only one pantograph-like arrangement is used, the arrangement is normally called a single-pantograph lifting platform, while if a plurality of pantographs are used the arrangement is called a multi-pantograph lifting platform.

One disadvantage with such arrangements, however, is that the platform often requires a lot of space on the vehicle, causing the vehicle to be unnecessarily large.

Moreover, the vehicle itself can not pick up a load with this type of platform, unless the load is placed on especially constructed supports having a greater mutual distance apart than the breadth of the platform. A further disadvantage is that the platform cannot be lowered to the driving plane of the vehicle, since the pantograph can only operate on one side of the guide rail provided on the vehicle. Because of these inherent disadvantages, such lifting platforms can only be used as, for example, working platforms, loading ramps for loading and unloading aircraft, and similar working operations.

Other constructions are also known to the art. These constructions however, have not been used to any appreciable extent because of the fact that they are expensive, bulky, complicated, have poor handling characteristics, or for other reasons.

An object of the present invention is to provide a linkage system particularly intended for vehicle-carried load-lifting arrangements, said system having a geometry such that a load can be moved rectilinearly or at least substantially rectilinearly in a vertical direction from a level which is lower than the point at which the linkage system is mounted on the vehicle to a level which is higher than said point or vice-versa.

The invention is characterized in that a lifting-force generating means is connected with the linkage system in a manner such that when a load is lifted or lowered said load is moved vertically from a height position below the guide for the link arm of the linkage system to a height position above said guide or vice-versa whilst the end of the link arm which is journalled in the guide is moved substantially horizontally.

The disadvantages of hitherto known lifting arrangements of this kind are eliminated by means of the linkage system according to the invention. Thus, the driver of the vehicle has an unobstructed view. The free-lift height is relatively high since no fixed, vertical load-carrying beams are present. Further, the load is better distributed on the wheels of the vehicle than when vertical guide frames are used. The load is held in a horizontal position in an uncomplicated manner. The driving stability and lifting stability of the vehicle is also improved in relation to known lifting arrangements of this kind.

Figure 2:
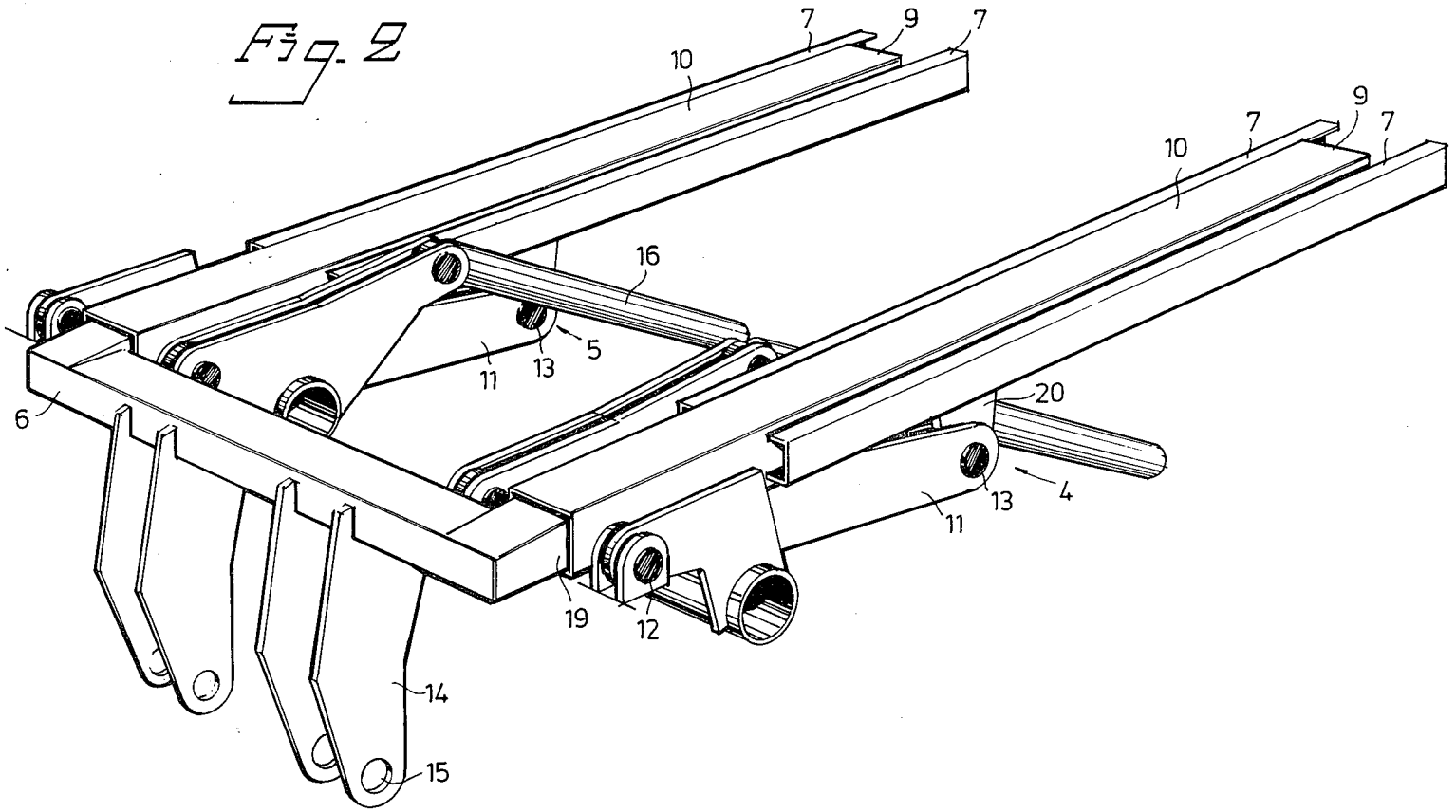
Figure 3:
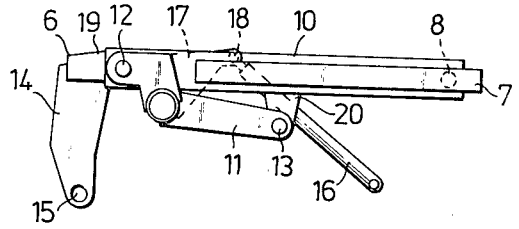
Figure 4:
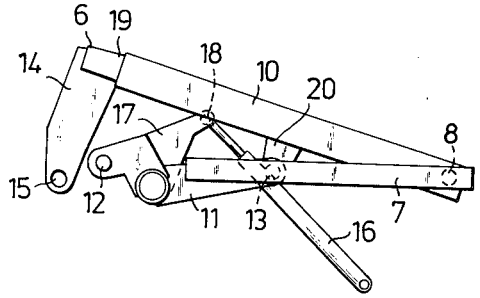
Figure 5:
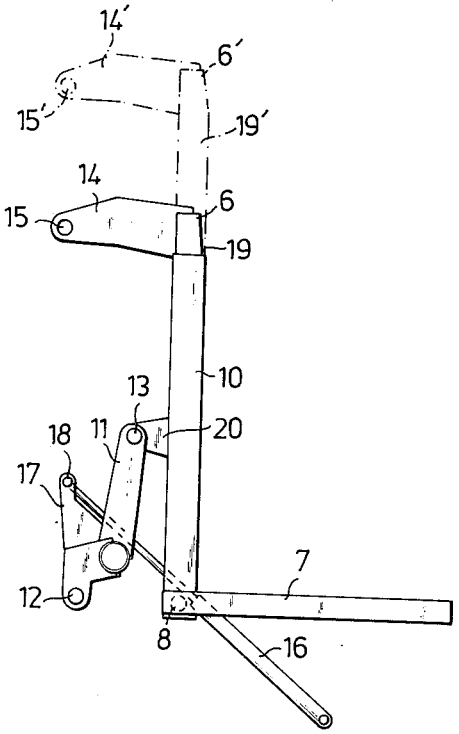

So that the invention will be more readily understood and optional features thereof made apparent an exemplary embodiment of the invention will now be described with reference to the accompanying schematic drawings, in which like elements have been identified by like reference numerals. In the drawings:

FIG. 1 is a perspective view of a fork-lift truck provided with a lifting means having a linkage system according to the invention, FIG. 2 is a perspective view of the lifting arrangement with the linkage system shown on the truck illustrated in FIG. 1, FIG. 3 is a side view of the lifting arrangement shown in FIG. 2, said lifting arrangement being shown in its lowermost position, FIG. 4 illustrates the lifting arrangement in an intermediate position during a lifting operation, and FIG. 5 illustrates the lifting arrangement in its uppermost or highest position.

In FIG. 1 there is illustrated a lifting truck 1 having mounted thereon a lifting arrangement 2 having two lifting-arms 3. The lifting arrangement 2 comprises two linkage systems 4 and 5 in accordance with the invention, one on each side of the truck. The linkage systems 4,5 are coupled together by means of a beam 6 located on the front of the truck. The arms 3 of the forks are also mounted on the beam 6.

FIG. 2 illustrates the lifting arrangement 2 in a different perspective and in a larger scale than in FIG. 1. Each of the linkage systems 4,5 is displaceably mounted on a respective one of two horizontal guide beams 7 arranged on the truck. Mounted adjacent the ends 9 of tubular beams 10, forming part of the link arms of the two linkage systems, are rollers 8 (not shown in FIG. 2) which are arranged to run in said guide beams. Links 11 of the linkage systems 4,5 are pivotally mounted at one end thereof on the truck by means of a respective shaft 12. The links 11 are pivotally mounted at the other ends thereof on projections 20 on the tubular beams 10, by means of shafts 13. Mounted on the cross beam 6 are four arms 14 in which the lifting fork is pivotally mounted via shafts received in holes 15. The linkage arms of the linkage systems are formed by said arms and the tubular beams 10. Rotation of the fork holder is controlled by means of a hydraulic piston-cylinder arrangement (not shown) in a manner such that they are held in a horizontal position during a lifting or lowering operation. The means for applying the lifting force comprises a hydraulic piston-cylinder arrangement 16 (one for each linkage system) which is mounted on the truck and connected to two tongues 17 of the link 11 via a rotary shaft 18. Inserted in each of the tubular beams 10 is a respective extensible telescopic arm 19. The cross beam 6 is fixedly attached to these telescopic arms.

FIG. 3 illustrates a working position of the lifting arrangement in which the forks 3 are located close to the ground. The geometric form of the linkage arm 10,14 has been adapted so that it extends around the wheel on the lifting truck. By means of this arrangement, the shaft 15 can pass the shaft 12 and the lifting arrangement consequently obtains a total lifting height which is greater than when the shaft 15 only operates on one side of the shaft 12, as with a pantographic lifting arrangement.

FIG. 4 illustrates a working position in which the roller 8 and the shafts 12 and 13 are located substantially in the same horizontal plane. In known constructions, this position forms a dead-point position, which is solved, however, according to the invention by the fact that the lifting cylinder 16 is coupled to a location (the shaft 18) on the link 11 in a manner such that the cylinder provides a rotary moment around the rotary shaft 12 during the whole of the rotation of the link 11.

FIG. 5 illustrates the linkage system in its highest working position, the chain lines illustrating a position which the link arm adopts when the telescopic arm 19 has been extended and the load, in consequence hereof, continues to be lifted substantially linearly.

As will be seen from FIGS. 3, 4 and 5 (with the telescopic arm withdrawn) the roller 8 and the shafts 13 and 15 adopt the same mutual positions during the whole of a lifting or lowering operation, the distance between the shafts 12 and 13 being substantially equal to the distance between the roller 8 and the shaft 13.

The invention can also be used for handling and lifting packages, such as containers, in which a lifting arrangement having a lifting frame as the load-carrying means is connected to the upper side of the package. Such load-carrying means can be provided with, for example buckets or clamping devices, instead of lifting forks.

What I claim is:

1. A linkage system for load-lifting arrangements comprising a frame and a link whose one end is pivotally connected to a link arm at a location between one end of the link arm and the other end of said link arm and whose other end is pivotally connected to the frame, said one end of the link arm being provided with load-carrying means and said other end being journalled in a guide which is arranged to guide said other end of the link arm substantially linearly and horizontally during a lifting or lowering operation, characterized by a lifting means comprising at least one linear motor which is connected between the frame and an intermediate point on the link and is arranged to cause the link to rotate about its bearing on the frame so as to enable during a lifting or lowering operation, the end of the link arm having the load-carrying means to be moved vertically from a height position below said guide to a height position above said guide, or vice versa, whilst simultaneously moving the end of the link arm which is mounted in the guide substantially horizontally, said linkage system comprising part of a vehicle-carried lifting arrangement comprising two parallel operating systems one on each side of the vehicle, characterized in that the other end of the link is pivotally mounted on the vehicle, and in that the lifting means acts between the frame of the vehicle and the link.

2. A linkage system according to claim 1, characterized in that the link arm when in its lowermost working position adopts a substantially horizontal position, whilst in its uppermost working position adopts a substantially vertical position.

3. A linkage system according to claim 1, characterized in that the link arm is provided with a telescopic, carrying part.

4. A linkage system according to claim 1, characterized in that the load-carrying means is held in a horizontal position during a lifting and lowering operation by at least one linear motor.

5. A linkage system according to claim 1, characterized in the link connection point on the link arm lies on a tongue projecting outwardly, downwardly from the link arm and comprises an integral part thereof, said tongue adopting a position below the horizontal plane of the horizontal guide when the link arm is in its horizontal position.

6. A linkage system according to claim 5, characterized in that the link arm is substantially of F-shaped configuration, wherein the link connection point lies adjacent the end of the lower horizontal arm of the F, whilst that end of the link arm which is provided with the load carrying means lies adjacent the end of the upper horizontal arm of the F.

7. A linkage system according to claim 1, characterized in that the load-carrying means is held in a horizontal position during a lifting and lowering operation by at least one rotary motor.

* * * * *